US006886666B2

(12) United States Patent
Stucky et al.

(10) Patent No.: US 6,886,666 B2
(45) Date of Patent: May 3, 2005

(54) ELEVATOR LOAD BEARING ASSEMBLY HAVING A DETECTABLE ELEMENT THAT IS INDICATIVE OF LOCAL STRAIN

(75) Inventors: Paul A. Stucky, Groton, CT (US); Neil R. Baldwin, Manchester, CT (US); Anton I. Lavrentyev, Cromwell, CT (US); William A. Veronesi, Hartford, CT (US)

(73) Assignee: Otis Elevator Company, Farmington, CT (US)

( * ) Notice: Subject to any disclaimer, the term of this patent is extended or adjusted under 35 U.S.C. 154(b) by 0 days.

(21) Appl. No.: 10/406,562

(22) Filed: Apr. 3, 2003

(65) Prior Publication Data

US 2003/0221917 A1 Dec. 4, 2003

Related U.S. Application Data

(63) Continuation of application No. 09/970,451, filed on Oct. 3, 2001, now abandoned.

(51) Int. Cl.[7] ..... B66B 1/34

(52) U.S. Cl. ..... 187/393; 73/158; 73/862.56

(58) Field of Search ..... 187/391, 393; 73/158, 862.391, 862.41, 862.381, 862.453, 862.471, 862.473, 862.56, 863.471; 324/522, 539, 543

(56) References Cited

U.S. PATENT DOCUMENTS

| | | | | |
|---|---|---|---|---|
| 4,602,476 A | | 7/1986 | Riggs et al. | |
| 5,015,859 A | | 5/1991 | Uejio | |
| 5,834,942 A | | 11/1998 | De Angelis | |
| 5,890,564 A | | 4/1999 | Olsen et al. | |
| 5,992,574 A | | 11/1999 | Olsen et al. | |
| 6,073,728 A | | 6/2000 | Olsen et al. | |
| 6,080,982 A | | 6/2000 | Cohen | |
| 6,247,359 B1 | | 6/2001 | DeAngelis | |
| 6,289,742 B1 | | 9/2001 | DeAngelis | |
| 2003/0011483 A1 | * | 1/2003 | Lamb et al. | 340/664 |

FOREIGN PATENT DOCUMENTS

| | | |
|---|---|---|
| DE | 303677 | 2/1918 |
| DE | 2 159995 | 6/1973 |
| EP | 0 103 162 A2 | 3/1984 |
| FR | 2 410 077 | 6/1979 |
| FR | 2676814 | 11/1992 |
| GB | 2 152 088 A | 7/1985 |
| WO | WO 00/58706 | 10/2000 |

* cited by examiner

*Primary Examiner*—Jonathan Salata
(74) *Attorney, Agent, or Firm*—Carlson, Gaskey & Olds

(57) ABSTRACT

A load bearing member, such as a polymer cord reinforced belt, includes at least one element of a different material having a characteristic that distinguishes it from the polymer fibers that make up the strands of the cord. The element of second material has a configuration that is repeated along the length of the load bearing member. The configuration of the second material element provides a readily detectible indication of localized strain on the load bearing member. As the load bearing member is strained over time, the configuration of the second material element is also altered. Analyzing the configuration of the second material element along the length of the load bearing member provides information regarding the condition of the belt.

36 Claims, 2 Drawing Sheets

ELEVATOR LOAD BEARING ASSEMBLY HAVING A DETECTABLE ELEMENT THAT IS INDICATIVE OF LOCAL STRAIN

This application is a Continuation of U.S. Patent application Ser. No. 09/970,451, which was filed on Oct. 3, 2001, now abandoned.

BACKGROUND OF THE INVENTION

This invention generally relates to load bearing assemblies for elevator systems. More particularly, this invention relates to an arrangement for readily detecting localized strain in an elevator load bearing assembly.

Elevator systems typically include a cab and counterweight that are coupled together using an elongated load bearing member. Typical load bearing members include steel ropes and, more recently, synthetic ropes and multi-element ropes such as polymer coated reinforced belts. The increasing use of elevators in high-rise buildings has given rise to the need for an increasing use of the polymer coated reinforced belts because of their weight-to-strength ratios compared to steel roping arrangements.

Inspecting a load bearing member in an elevator system has been accomplished in several ways. With conventional steel roping, a manual, visual inspection of the rope allows the technician to determine when particular strands of the steel rope are frayed, broken or otherwise worn. This inspection method is limited, however, to the exterior portions of the rope and does not provide any indication of the condition of interior strands of the rope. Additionally, this inspection method is somewhat difficult and time consuming and does not always permit complete inspection of the entire length of the load bearing arrangement.

There are similar limitations on using visual inspection techniques on newer ropes. For example, the polymer coated reinforced belts do not permit visual inspection because of the coating that is typically applied over the cords, which are made up of strands of polymer material. Several advances have been proposed for facilitating inspection of such load bearing arrangements. One example is shown in U.S. Pat. No. 5,834,942 where a voltage detection unit is included in the load bearing member. By measuring an electrical voltage across that unit, a determination is made regarding the condition of the load bearing member. This proposal is limited, however, in that it does not provide any information regarding locations of strain along the length of the load bearing member. Moreover, there is no way of guaranteeing that a loss of conductivity through the voltage detection unit is directly correlated to strain or damage to the load bearing member. Another shortcoming of such an arrangement is that there is no qualitative information regarding degradation of the load bearing member over time.

There is a need for improved arrangements and methods for determining the condition of load bearing members in elevator assemblies. This invention provides a unique solution to that problem.

SUMMARY OF THE INVENTION

In general terms, this invention is a load bearing member assembly for use in an elevator system. The inventive arrangement includes a first material that forms a portion of the load bearing member. An element of a second material is associated with the load bearing member assembly. The second material has a material characteristic that distinguishes the second material from the first material. The element of second material is arranged relative to the remainder of the load bearing assembly such that it has a configuration that is repeated along the length of the load bearing member. Detecting the configuration of the element provides an indication of local strain on identifiable portions of the load bearing assembly.

One example arrangement includes a plurality of fibers of a first material that are arranged into a plurality of strands. At least one filament of a second material that has a characteristic that distinguishes it from the first material is associated with the plurality of strands. The filament of second material has a configuration that is repeated at consistent intervals along the length of the load bearing member when the load bearing member is in a first condition. The configuration of the filament of second material changes along a portion of the load bearing member responsive to a strain on that portion of the load bearing member. Therefore, changes in the configuration of the filament of second material provides an indication of the condition of the load bearing member at specific locations.

A method of this invention for assembling a load bearing member for use in an elevator system includes winding a plurality of fibers of a first material together to form a plurality of strands. An element of a second material, which has a different characteristic than the first material, is arranged relative to the strands such that the element of second material has a repeated configuration along the length of the load bearing member. The configuration of the element of second material changes along a portion of the length of the load bearing member responsive to strain on that portion of the load bearing member.

In one example, the method of assembling a load bearing member includes placing a filament of second material at the center of one of the strands and winding the strands together to form a cord. The winding pattern of the strand containing the second material filament provides the repeated configuration of the filament.

The various features and advantages of this invention will become apparent to those skilled in the art from the following detailed description of the currently preferred embodiment. The drawings that accompany the detailed description can be briefly described as follows.

DETAILED DESCRIPITION OF THE PREFERRED EMBODIMENTS

Figure 1:
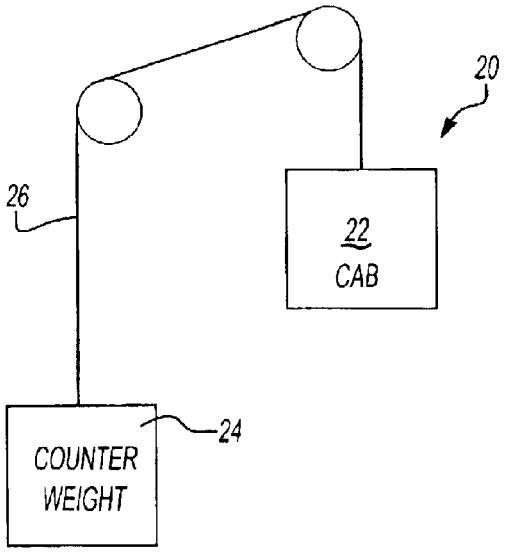
FIG. 1 schematically illustrates an elevator system.

FIG. 1 schematically shows an exemplary elevator system 20 that includes a cab 22 and a counterweight 24. A load bearing member assembly 26 couples the cab 22 and counterweight 24 together so that the cab 22 can be moved between landings in a building, for example, in a conventional fashion.

The load bearing member assembly 26 may take a variety of forms. One example is a flat belt containing polymer reinforced strands. Other examples include flat, coated steel belts; synthetic ropes; and multi-element ropes. This invention is not limited to "belts" in the strictest sense. A flat belt is used as one example of a load bearing member designed according to this invention. Therefore, any reference to a "belt" within this description is not intended to be limiting in any sense.

Figure 2:
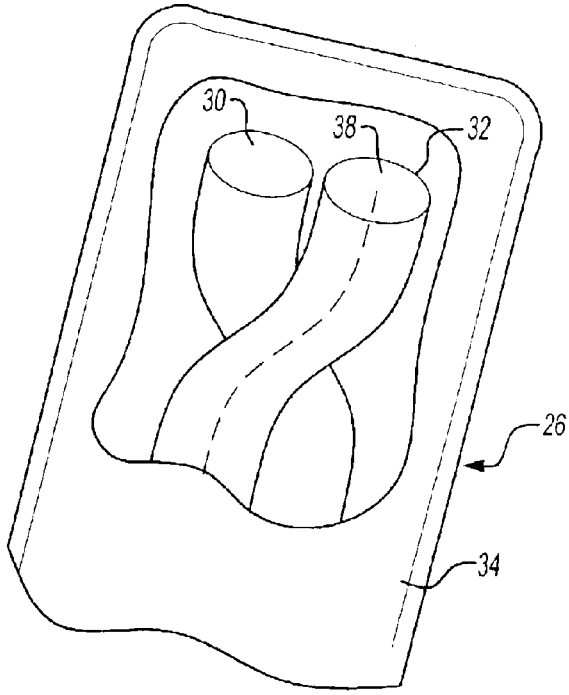
FIG. 2 schematically illustrates an exemplary load bearing member designed according to an embodiment of this invention.
Figure 3:
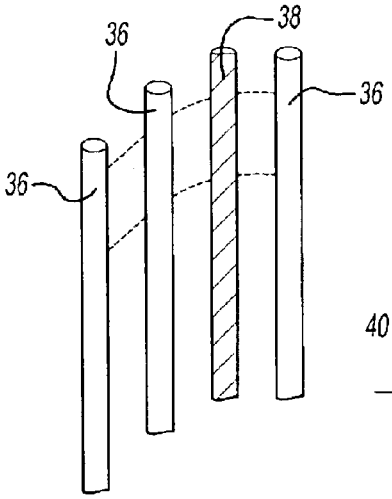
FIG. 3 illustrates selected portions of a load bearing member designed according to an embodiment of this invention.

The example load bearing member assembly 26 shown in FIG. 2 includes a plurality of strands 30 and 32 that are wound together in a known manner to form at least one cord. A first material preferably is used to form the strands 30 and 32. The illustrated strands are coated with a coating 34, which protects the strands from wear and provides friction characteristics for driving the elevator system components as needed. This invention is not limited to coated belt arrangements.

A load bearing member assembly designed according to this invention includes an element of a second material that has at least one characteristic that distinguishes it from the first material. The element of second material is associated with the remainder of the load bearing member such that the element has a configuration that is repeated at regular intervals along a length of the load bearing member. Example configurations include an internal property such as crystalline structure or an external property such as a physical arrangement relative to the load bearing member.

Localized strain in the load bearing member causes an alteration in the configuration of the second material element. Because the second material has at least one characteristic that distinguishes it from the first material, such alteration is readily measurable. The technique for measuring the alteration of the second material element depends upon the nature of the distinguishing characteristic. Changes in the configuration of the second material element can be correlated to a loss of strength or other alteration in the condition of the load bearing member.

Having a second material with a distinguishing characteristic and a repeated configuration along the length of the load bearing member provides a reliable source of information regarding localized strain on the load bearing member. A variety of distinguishing characteristics may be used. Some of the characteristics may be a physical characteristic of the second material. Example characteristics include density, magnetic absorption properties, wavelength absorption properties and crystalline structure. The chosen distinguishing characteristic will dictate the method of observing the geometry or configuration of the second material element. For example, when density is the distinguishing characteristic, x-ray technology may be used to obtain an image of the configuration of the second material element at discrete portions along the length of the load bearing member assembly. Known techniques can be used to observe the configuration of the second material element to obtain the desired information based upon the distinguishing characteristic used in a specific embodiment. Those skilled in the art who have the benefit of this description will be able to choose from among the possible materials, material characteristics and observation techniques to obtain the results provided by this invention.

There are a variety of ways to incorporate the second material element into the load bearing member assembly. One example includes integrating the second material element into the assembly of the load bearing member. In this example, the second material element is a filament 38 at the center of one of the strands. When the strands are wound together (in a helical arrangement, for example) the filament 38 has a resulting geometric pattern that is consistent with the lay length of the strands along the load bearing member. Observing the configuration of the filament 38 along the length of the load bearing member provides an indication of the structural condition of the load bearing member.

One example method of assembling a load bearing member 26 designed according to this invention includes placing the filament 38 at the center of a strand 32. In other words, a plurality of fibers 36 of the first material are placed in a position to surround the filament 38. Once that strand is assembled, it is then wound with other strands, each of which are made up of a plurality of fibers 36 of the first material. The winding together of the strands not only forms a cord but also establishes the configuration of the filament 38 that is repeated along the length of the load bearing member 26. A typical arrangement provides a helical geometry with a repeated period along the length of the load bearing member 26. The period of the filament 38 geometry in this example preferably corresponds directly to the lay length of one or more of the strands of the cord.

Figure 4:
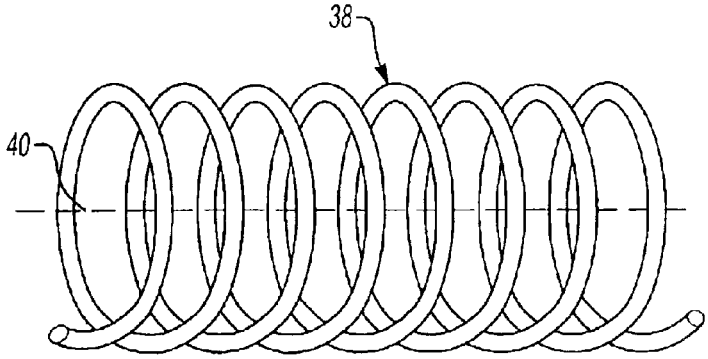
FIG. 4 schematically illustrates an exemplary configuration pattern of a filament used in connection with this invention.

FIG. 4 schematically illustrates the configuration of a filament 38 in an arrangement where the filament is within a strand in a helically wound arrangement. The helical pattern of the filament 38 is repeated along the axis 40 of the load bearing member 26.

Figure 5:
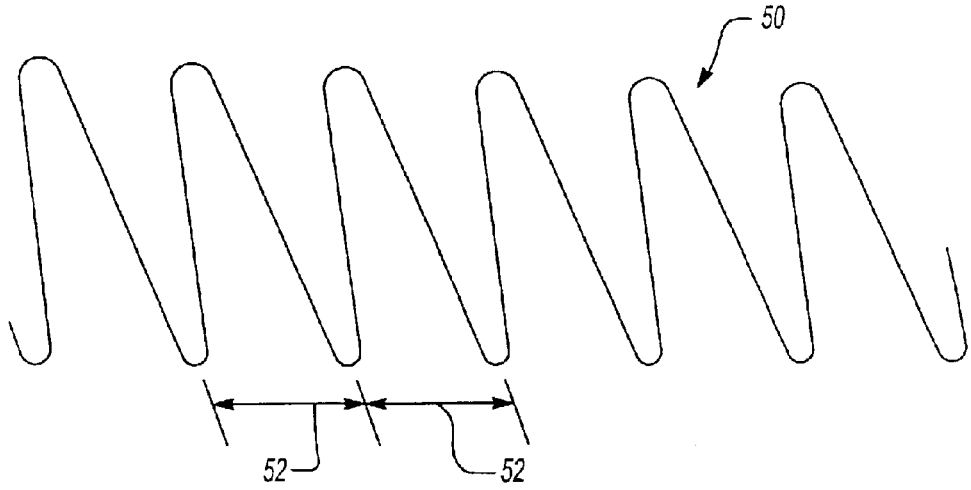
FIG. 5 schematically illustrates a projected image of the configuration pattern of FIG. 4.

FIG. 5 illustrates an image 50 of the filament 38 of FIG. 4 projected onto a single plane. The period 52 of the configuration of the filament 38 preferably is regular and repeated when the load bearing member is not stressed. Alterations in the period provide an indication of the condition of the load bearing member in particular locations. For example, when the length or period 52 is greater along one portion of the load bearing member compared to other portions, that is an indication that the former portion has been subjected to strain because of load, for example. Depending on the particular configuration of the load bearing member 26, a certain threshold or tolerance can be determined for making a decision when an elongation of the filament configuration within a portion of the load bearing member provides an indication of sufficient wear that repair or replacement is necessary. Those skilled in the art who have the benefit of this description will be able to determine how to establish an appropriate threshold for a particular load bearing member arrangement.

Figure 6:
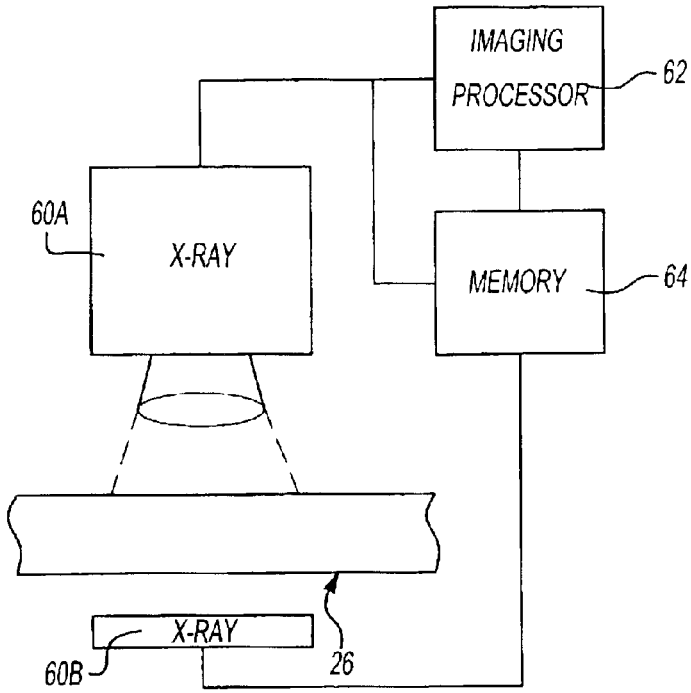
FIG. 6 schematically illustrates an inspection device arrangement for determining the strength characteristics of a load bearing member assembly designed according to an embodiment of this invention.

Obtaining an image such as that shown in FIG. 5 can be achieved in several ways. In one example, low voltage x-ray machinery 60A and 60B is used. A digital imaging processor 62 and memory 64 are shown schematically in FIG. 6. Utilizing a metallic filament 38 or a polymer filament having a higher density than the material used for the filaments 36 renders the filament 38 readily recognizable using x-ray technology. As the x-rays pass through the load bearing member 26 from the source 60A to the detector 60B, they are more strongly absorbed by the filament 38 compared to the fibers 36. The image of the filament against the polymer cord background preferably is processed by a computer or microprocessor to extract the configuration information of the filament versus position along the length of the load bearing member 26.

Because different patterns may be chosen the particular distinguishing characteristic and its relationship to the remainder of the load bearing member assembly preferably is chosen to optimize detection. The detectable element of second material may be incorporated into the load bearing member at any stage of assembly and may be used to provide an indication in a variety of ways.

The selection of the second material will depend, in part, on the first material used for making the load bearing member. A variety of commercially available materials can be used as the first or structural material. The structural material of the load bearing member may be, for example, a metal, multiple metals, metallic alloys or a metal matrix composite. Other possibilities include polymeric materials or any combination of polymeric and metallic materials. Example polymeric materials include PBO, which is sold under the trade name Zylon; liquid crystal polymers such as a polyester-polyarylate, which is sold under the trade name Vectran; p-type aramids such as those sold under the trade names Kevlar, Technora and Twaron; or an ultra-high molecular weight polyethylene, an example of which is sold under the trade name Spectra; and nylon.

The material selected for the detectable element 38 may be any one of the materials mentioned above. Given this description, those skilled in the art will be able to select appropriate materials to meet the needs of their particular situation or to accommodate their chosen detection techniques.

The selection of materials, for example, will depend upon whether the chosen configuration (used for strain recognition) will be an external property such as the geometry or physical arrangement of the second material element or an internal property such as the crystalline structure or density of the material.

In one example, regions of higher local strain will be indicated by a local increase in the length or period 52. Comparing local lay length versus position for a fatigued cord with a baseline measurement when the cord is in a first, acceptable structural condition (i.e., has not been strained), provides an indicator of the amount of strain at a particular portion of the load bearing member. Another comparing factor may be a correlating factor determined by observing an unstrained belt and comparing that to an area that has been strained to a known condition. For example, a belt section having a loss of belt breaking strength as derived from known bending fatigue tests can be utilized to provide a sample of a load bearing member that may not be fit for continued operation. The corresponding element configuration within that section gives a visual indication of such a belt condition. That measurement can be used for comparisons to actual measurements on belts in service to discern a condition of the belt In another example, the filament 38 is a ferromagnetic wire such as steel. In this example, magnetic detection techniques such as a known magnetic flux leakage technique can be utilized to detect each turn of the helical arrangement of the filament 38. Because such magnetic detection techniques are already used for belt inspection, this provides an advantage for this invention to be accommodated by current inspection machinery or devices.

In examples where the filament 38 is non-ferromagnetic, an eddy current nondestructive detection technique is usable to sense the lay-length periodicity (i.e., the configuration) of the filament 38. Eddy current detection techniques are known. Either the magnetic detection technique or the eddy current detection technique provides information regarding locations of the portions of the filament 38, which provides an indication of the lay length 52.

In another example, the coating 34 is optically transparent and optical imaging is used to determine the configuration of the filament 38. In one such example, the filament 38 is wound around the outside of a cord making it visible through the coating 34. Preferably a high resolution video system obtains an image of the filament, which is digitally processed to determine the configuration characteristic that is an indicator of belt strain. In arrangements where optical imaging is used, the distinguishing characteristic of the filament 38 may be a different color compared to the color of the fibers 36, for example.

This invention provides the ability to detect localized strain on individual portions of the load bearing member 26. As the polymer fibers becomes strained, a corresponding portion of the load bearing member 26 will typically be elongated. A corresponding elongation in the configuration of the filament 38 provides an indication of the structural condition of that portion of the load bearing member 26.

This invention provides a versatile way of determining the strength characteristics of the load bearing member to meet a variety of criteria depending on the needs of a particular situation.

The preceding description is exemplary rather than limiting in nature. Variations and modifications to the disclosed embodiments may become apparent to those skilled in the art that do not necessarily depart from the essence of this invention. The scope of legal protection given to this invention can only be determined by studying the following claims.

We claim:

1. A load bearing member for use in an elevator system, comprising:

a plurality of fibers of a first material that are arranged into a plurality of stands; and at least one element of a second material having a characteristic that distinguishes the second material from the first material and having a first configuration that is repeated along a length of the load bearing member when the load bearing member is in a first condition, the element of second material is a part of at least one of the strands, the configuration of the element of second material changing along a portion of the load bearing member responsive to a strain on the portion of the load bearing member.

2. The load bearing member of claim 1, wherein the distinguishing characteristic is at least one of the characteristics chosen from the group of crystalline structure, magnetic properties, wavelength absorption and density.

3. The load beating member of claim 1, wherein the first material comprises a metal and the second material comprises a polymer.

4. The load bearing member of claim 1, wherein the first material comprises a polymer and the second material comprises a metal.

5. The load bearing member of claim 1, wherein the first material comprises a first polymer and the second material comprises a second polymer.

6. The load bearing member of claim 1, wherein the first material comprises a first metal and the second material comprises a second metal.

7. The load bearing member of claim 1, wherein at least one of the first or second materials comprises a polymer selected from the group of PBO, polyester-polyarylate, p-type aramid, ultra high molecular weight polyethylene, and nylon.

8. The load bearing member of claim 1, wherein the element of second material is a filament positioned within one of the strands at a center of the one strand.

9. The load bearing member of claim 8, wherein the one strand is wound together with others of the plurality of strands in a selected pattern such that the filament of second material has a helical geometry with a period that corresponds to a lay length of the pattern of the strands.

10. A method of assembling a load bearing member for use in an elevator system where the load bearing member has a plurality of fibers of a first material and at least one element of a second material having a characteristic that distinguishes the second material from the first material, comprising the steps of:

(A) arranging a plurality of fibers of the first material together to form a plurality of strands; and (B) arranging the element of the second material as part of at least one of the strands such that the element of the second material has a repeated configuration along a length of the load bearing member and such that the configuration changes along a portion of the length of the load bearing member responsive to a strain on the portion of the load bearing member.

11. The method of claim 10, wherein step (B) is performed while performing step (A).

12. The method of claim 10, including combining a set of the fibers of the first material with the element of the second material to form a first one of the strands;

arranging a remainder of the fibers of the first material into at least a second one of the strands; and winding the first strand together with at least the second strand to form a cord such that the element of second material has a geometry that repeats along a length of the cord.

13. The method of claim 12, wherein the second material element is a filament and step (B) includes winding the sot of first material fibers around the filament such that the filament is located at a center of the first one of the strands.

14. A method of inspecting a load bearing member in an elevator system where the load bearing member includes a plurality of load bearing strands of a first material and at least one element of a second material that has a characteristic that distinguishes the second material from the first material and is arranged along the load bearing member such that the element has a repeated configuration along a length of the load bearing member when the load bearing member is in a first condition, comprising the steps of:

(A) inspecting the configuration of the second material element in a portion of the length of the load bearing member;

(B) determining a characteristic of the configuration of the second material element along the portion of the length; and (C) determining a condition of at least one of the load bearing strands in the portion of the length based upon the determination of step (B).

15. The method of claim 14, including determining a threshold amount of change in the element configuration pattern compared to the first configuration and determining that the load bearing member needs service or replacement when a change in the determined characteristic exceeds the threshold amount.

16. The method of claim 14, wherein step (C) includes determining whether the portion of the element configuration has a geometry that is different compared to another portion of the element configuration.

17. The method of claim 14, wherein step (A) includes obtaining an image of the element from the portion of the load bearing member.

18. The method of claim 14, wherein step (A) includes at least one of taking an x-ray of the portion of the load bearing member or obtaining magnetic flux leakage information regarding the portion of the load bearing member or subjecting the portion of the load bearing member to an eddy current detection technique.

19. The method of claim 14, wherein the characteristic of step (B) includes a periodic length of the element.

20. A load bearing member for use in an elevator system, comprising:

a plurality of fibers of a first metal material that are arranged into a plurality of strands; and at least one element of a second, polymer material having a characteristic that distinguishes the second material from the first material and having a first configuration that is repeated along a length of the load bearing member when the load bearing member is in a first condition, the configuration of the element of second material changing along a portion of the load bearing member responsive to a strain on the portion of the load bearing member.

21. A load bearing member for use in an elevator system, comprising:

a plurality of fibers of a first polymer material that are arranged into a plurality of strands; and at least one element of a second polymer material having a characteristic that distinguishes the second material from the first material and having a first configuration that is repeated along a length of the load bearing member when the load bearing member is in a first condition, the configuration of the element of second material changing along a portion of the load bearing member responsive to a strain on the portion of the load bearing member.

22. A method of assembling a load bearing member for use in an elevator system where the load bearing member has a plurality of fibers of a first material and at least one element of a second material having a characteristic that distinguishes the second material from the first material, comprising the steps of:

combining a set of the fibers of the first material with the element of the second material to form a first strand;

arranging a remainder of the fibers of the first material into at least a second strand; and winding the first strand together with at least the second strand to form a cord such that the element of second material has a geometry that repeats along a length of the cord and such that the geometry of the element of the second material changes along a portion of the length of the load bearing member responsive to a strain on the portion of the load bearing member.

23. The method of claim 22, wherein the second material element is a filament and the method includes winding the set of first material fibers around the filament such that the filament is located at a center of the first strand.

24. A method of inspecting a load bearing member in an elevator system where the load bearing member includes a plurality of strands of a first material and at least one element of a second material that has a characteristic that distinguishes the second material from the first material and is arranged along the load bearing member such that the element has a repeated configuration along a length of the load bearing member when the load bearing member is in a first condition, comprising the steps of:

(A) obtaining an image of the second material element in a portion of the length of the load bearing member;

(B) determining a characteristic of the configuration of the second material element along the portion of the length based upon the obtained image; and (C) determining a condition of the portion of the length based upon the determination of step (B).

25. The method of claim 24, wherein the load bearing member includes an optically transparent coating and the second material element is visible through the coating.

26. The method of claim 25, wherein the distinguishing characteristic of the second material element comprises a color that is different from a color of the first material.

27. A load bearing member for use in an elevator system, comprising:

a plurality of fibers of a first material that are arranged into a plurality of strands; and at least one element of a second material having a characteristic that distinguishes the second material from the first material and is the same along an entire length of the element, the element having a first configuration that is repeated along a length of the load bearing member when the load bearing member is in a first condition, the element of second material is a part of at least one of die strands, the configuration of the element of second material changing along a portion of the load bearing member responsive to a strain on the portion of the load bearing member.

28. The load bearing member of claim 27, wherein the distinguishing characteristic is at least one of the characteristics chosen from the group of crystalline structure, magnetic properties, wavelength absorption and density.

29. The load bearing member of claim 27, wherein the element of second material is a filament positioned within one of the strands at a center of the strand and wherein the one strand is wound together with others of the plurality of strands in a selected pattern such that the filament of second material has a helical geometry with a period that corresponds to a lay length of the pattern of the strands.

30. A method of assembling a load bearing member for use in an elevator system, comprising:

providing a plurality of fibers of a first material;

providing at least one element of a second material having a characteristic that distinguishes the second material from the first material and that is the same along an entire length of the element;

arranging a plurality of fibers of the first material together to form a plurality of strands; and arranging the element of the second material as part of at least one of the strands such that the element of the second material has a repeated configuration along a length of the load bearing member and such that the configuration changes along a portion of the length of the load bearing member responsive to a strain on the portion of the load bearing member.

31. A method of inspecting a load bearing member in an elevator system where the load bearing member includes a plurality of load bearing strands of a first material and at least one element of a second material that has a characteristic that distinguishes the second material from the first material and is the same along an entire length of the element, the element is arranged along the load bearing member such that die element has a repeated configuration along a length of the load bearing member when the load bearing member is in a first condition, comprising the steps of:

(A) inspecting the configuration of the second material element in a portion of the length of the load bearing member;

(B) determining a characteristic of the configuration of the second material element along the portion of the length; and (C) determining a condition of at least one of the load bearing strands in the portion of the length based upon the determination of step (B).

32. The method of claim 31, including determining a threshold amount of change in the element configuration pattern compared to the first configuration and determining that the load bearing member needs service or replacement when a change in the determined characteristic exceeds the threshold amount.

33. The method of claim 31, wherein step (C) includes determining whether the portion of the element configuration has a geometry that is different compared to another portion of the element configuration.

34. The method of claim 31, wherein step (A) includes obtaining an image of the element from the portion of the load bearing member.

35. The method of claim 31, wherein step (A) includes at least one of taking an x-ray of the portion of the load bearing member or obtaining magnetic flux leakage information regarding the portion of the load bearing member or subjecting the portion of the load bearing member to an eddy current detection technique.

36. A method of assembling a load bearing member for use in an elevator system, comprising:

providing a plurality of fibers of a first material;

providing at least one element of a second material having a characteristic that distinguishes the second material from the first material and is the same along an entire length of the element;

combining a set of the fibers of the first material with the element of the second material to form a first strand;

arranging a remainder of the fibers of the first material into at least a second strand; and winding the first strand together with at least the second strand to form a cord such that the element of second material has a geometry that repeats along a length of the cord and such that the geometry of the element of the second material changes along a portion of the length of the load bearing member responsive to a strain on the portion of the load bearing member.

* * * * *

UNITED STATES PATENT AND TRADEMARK OFFICE

CERTIFICATE OF CORRECTION

PATENT NO. : 6,886,666 B2
DATED : May 3, 2005
INVENTOR(S) : Stucky et al.

It is certified that error appears in the above-identified patent and that said Letters Patent is hereby corrected as shown below:

Column 6,
Line 33, "stands" should read as -- strands --.

Column 7,
Line 33, "sot" should read as -- set --.

Column 9,
Line 23, "die" should read as -- the --.

Column 10,
Line 5, "die" should read as -- the --.

Signed and Sealed this

Nineteenth Day of July, 2005

JON W. DUDAS
*Director of the United States Patent and Trademark Office*